US008382524B2

(12) United States Patent
Khilchenko et al.

(10) Patent No.: US 8,382,524 B2
(45) Date of Patent: Feb. 26, 2013

(54) ELECTRICAL CONNECTOR HAVING THICK FILM LAYERS

(75) Inventors: Leon Khilchenko, Manchester, NH (US); Mark W. Gailus, Concord, MA (US)

(73) Assignee: Amphenol Corporation, Wallingford, CT (US)

( * ) Notice: Subject to any disclaimer, the term of this patent is extended or adjusted under 35 U.S.C. 154(b) by 0 days.

(21) Appl. No.: 13/110,215

(22) Filed: May 18, 2011

(65) Prior Publication Data

US 2012/0094536 A1 Apr. 19, 2012

Related U.S. Application Data

(63) Continuation-in-part of application No. 12/784,914, filed on May 21, 2010.

(60) Provisional application No. 61/367,291, filed on Jul. 23, 2010, provisional application No. 61/386,782, filed on Sep. 27, 2010.

(51) Int. Cl.
*H01R 13/66* (2006.01)

(52) U.S. Cl. ..... 439/620.09

(58) Field of Classification Search ..... 439/620.09
See application file for complete search history.

(56) References Cited

U.S. PATENT DOCUMENTS

| | | | | |
|---|---|---|---|---|
| 3,115,379 | A | 12/1963 | McKee | |
| 3,825,994 | A | 7/1974 | Coleman | |
| 3,863,181 | A * | 1/1975 | Glance et al. | 333/243 |
| 3,978,375 | A | 8/1976 | Fukui et al. | |
| 4,464,003 | A | 8/1984 | Goodman et al. | |
| 4,596,428 | A | 6/1986 | Tengler | |
| 4,655,515 | A | 4/1987 | Hamsher, Jr. et al. | |
| 4,675,989 | A | 6/1987 | Galloway et al. | |
| 4,705,332 | A | 11/1987 | Sadigh-Behzadi | |
| 4,820,169 | A | 4/1989 | Weber et al. | |
| 4,824,383 | A | 4/1989 | Lemke | |
| 4,846,727 | A | 7/1989 | Glover et al. | |
| 4,878,155 | A | 10/1989 | Conley | |
| 4,882,554 | A | 11/1989 | Akaba et al. | |
| 4,952,172 | A | 8/1990 | Barkus et al. | |
| 4,965,933 | A | 10/1990 | Mraz et al. | |
| 4,975,069 | A | 12/1990 | Fedder et al. | |
| 4,975,084 | A | 12/1990 | Fedder et al. | |
| 5,046,960 | A | 9/1991 | Fedder | |
| 5,066,236 | A | 11/1991 | Broeksteeg | |

(Continued)

FOREIGN PATENT DOCUMENTS

| | | |
|---|---|---|
| EP | 0212764 A2 | 3/1987 |
| EP | 0422785 A2 | 4/1991 |

(Continued)

OTHER PUBLICATIONS http://kemet.com/kemet/web/homepage/kechome.nsf/vaprintpages/ceramic, copyright 2003, Kemet Electronic Corp.

(Continued)

*Primary Examiner* — James Harvey
(74) *Attorney, Agent, or Firm* — Blank Rome LLP

(57) ABSTRACT

An electrical connector electrically connects a first printed circuit board and a second printed circuit board, where the electrical connector includes: (a) an insulative housing; (b) a plurality of signal conductors, with at least a portion of each of the plurality of signal conductors disposed within the insulative housing; (c) each of the plurality of signal conductors having a first contact end, a second contact end and an intermediate portion therebetween; and (d) a passive circuit element electrically connected to the intermediate portion of each of the plurality of signal conductors, where the passive circuit element is housed in an insulative package and includes at least a capacitor or an inductor.

31 Claims, 14 Drawing Sheets

U.S. PATENT DOCUMENTS

| | | | | |
|---|---|---|---|---|
| 5,104,341 | A | 4/1992 | Gilissen et al. | |
| 5,117,331 | A | 5/1992 | Gebara | |
| 5,150,086 | A * | 9/1992 | Ito | 333/182 |
| 5,153,540 | A | 10/1992 | Gliha, Jr. | |
| 5,163,540 | A | 11/1992 | Mainquist et al. | |
| 5,224,867 | A | 7/1993 | Ohtsuki et al. | |
| 5,228,824 | A | 7/1993 | Satoyoshi | |
| 5,228,864 | A | 7/1993 | Fusselman et al. | |
| 5,249,098 | A | 9/1993 | Rostoker et al. | |
| 5,280,257 | A * | 1/1994 | Cravens et al. | 333/182 |
| 5,286,212 | A | 2/1994 | Broeksteeg | |
| 5,287,076 | A | 2/1994 | Johnescu et al. | |
| 5,340,334 | A | 8/1994 | Nguyen | |
| 5,342,211 | A | 8/1994 | Broeksteeg | |
| 5,403,206 | A | 4/1995 | McNamara et al. | |
| 5,496,183 | A | 3/1996 | Soes et al. | |
| 5,525,066 | A | 6/1996 | Morlion et al. | |
| 5,580,283 | A | 12/1996 | O'Sullivan et al. | |
| 5,702,258 | A | 12/1997 | Provencher et al. | |
| 5,795,191 | A | 8/1998 | Preputnick et al. | |
| 5,860,816 | A | 1/1999 | Provencher et al. | |
| 5,924,899 | A | 7/1999 | Paagman | |
| 5,941,447 | A | 8/1999 | Chu et al. | |
| 5,980,321 | A | 11/1999 | Cohen et al. | |
| 6,019,616 | A | 2/2000 | Yagi et al. | |
| 6,083,047 | A | 7/2000 | Paagman | |
| 6,152,742 | A | 11/2000 | Cohen et al. | |
| 6,168,469 | B1 | 1/2001 | Lu | |
| 6,183,301 | B1 | 2/2001 | Paagman | |
| 6,285,542 | B1 * | 9/2001 | Kennedy et al. | 361/328 |
| 6,325,644 | B1 | 12/2001 | Lemke et al. | |
| 6,375,510 | B2 | 4/2002 | Asao | |
| 6,379,188 | B1 | 4/2002 | Cohen et al. | |
| 6,409,543 | B1 | 6/2002 | Astbury, Jr. et al. | |
| 6,530,790 | B1 | 3/2003 | McNamara et al. | |
| 6,537,087 | B2 | 3/2003 | McNamara et al. | |
| 6,592,382 | B2 | 7/2003 | Wurster | |
| 6,623,280 | B2 | 9/2003 | Oldenburg et al. | |
| 6,652,318 | B1 | 11/2003 | Winings et al. | |
| 6,932,649 | B1 * | 8/2005 | Rothermel et al. | 439/620.01 |
| 7,285,018 | B2 | 10/2007 | Kenny et al. | |
| 7,540,781 | B2 | 6/2009 | Kenny et al. | |
| 7,887,371 | B2 * | 2/2011 | Kenny et al. | 439/620.22 |
| 2002/0098738 | A1 | 7/2002 | Astbury et al. | |
| 2003/0203683 | A1 | 10/2003 | Iwasaki | |
| 2004/0110421 | A1 * | 6/2004 | Broman et al. | 439/610 |
| 2004/0121652 | A1 * | 6/2004 | Gailus | 439/608 |
| 2005/0032430 | A1 | 2/2005 | Otsu et al. | |
| 2005/0121224 | A1 | 6/2005 | Lien | |
| 2005/0283974 | A1 * | 12/2005 | Richard et al. | 29/825 |
| 2005/0287869 | A1 | 12/2005 | Kenny et al. | |
| 2006/0068640 | A1 * | 3/2006 | Gailus | 439/608 |
| 2008/0194146 | A1 * | 8/2008 | Gailus | 439/608 |
| 2009/0291593 | A1 * | 11/2009 | Atkinson et al. | 439/607.06 |
| 2011/0287663 | A1 * | 11/2011 | Gailus et al. | 439/620.21 |
| 2012/0094536 | A1 * | 4/2012 | Khilchenko et al. | 439/620.21 |

FOREIGN PATENT DOCUMENTS

| | | | |
|---|---|---|---|
| EP | 0486298 | A1 | 5/1992 |
| EP | 0560550 | A2 | 9/1993 |
| EP | 1779472 | A1 | 5/2007 |
| GB | 2325354 | A | 11/1998 |
| JP | 5069890 | A | 3/1993 |
| JP | 6013133 | A | 1/1994 |
| JP | 6029060 | A | 2/1994 |
| JP | 6054257 | A | 2/1994 |
| JP | 6054259 | A | 2/1994 |
| JP | 06054274 | A | 2/1994 |
| JP | 06084557 | A | 3/1994 |
| JP | 06325829 | A | 11/1994 |
| JP | 07006823 | A1 | 1/1995 |
| JP | 07027059 | A | 1/1995 |
| JP | 07302649 | A | 11/1995 |
| JP | 9237656 | A | 9/1997 |
| JP | 10162909 | A | 6/1998 |
| JP | 10270124 | A | 10/1998 |
| JP | 10270133 | A | 10/1998 |
| JP | 10275662 | A | 10/1998 |
| JP | 10284194 | A | 10/1998 |
| JP | 10302895 | A | 11/1998 |
| WO | 8805218 | A1 | 7/1988 |
| WO | 9638889 | A1 | 12/1996 |
| WO | 0031832 | A1 | 6/2000 |

OTHER PUBLICATIONS

Author Unknown, "Phoenix Contact, 5 New Printed Circut Terminal Blocks," Phoenix Terminal Blocks, Inc., 1997 or earlier, pp. 5., Middletown, PA, USA.

Author Unknown, "Phoenix Contact, New Terminal Block Techonology," Phoenix Terminal Blocks, Inc., 1997 or earlier, pp. 1-36., Middletown, PA, USA.

Author Unknown, "Photographs of Berg Connector Module Bearing Code dnr2180/1.2," 1997 or earlier, 1p. (photographs of module of a connector sold to Berg Electronics. This contact elements are held between two pieces of insulator, which form the two sides of the module. In the photographs, the second side of the module contains grooves into which the loose contacts are placed.

Strawser, "Connecterized Circuitry Utilizing Polymer Thick Film," Methode Electronics, Inc., date unknown, pp. 283-286, Chicago, IL, USA.

Costlow, "Thick-Film Resistors, Chip Capacitators and Diodes Built on," Electronics Engineering Times, 1988, 3 pp., No. 51, Skokie, IL, USA.

* cited by examiner

FIG. 10
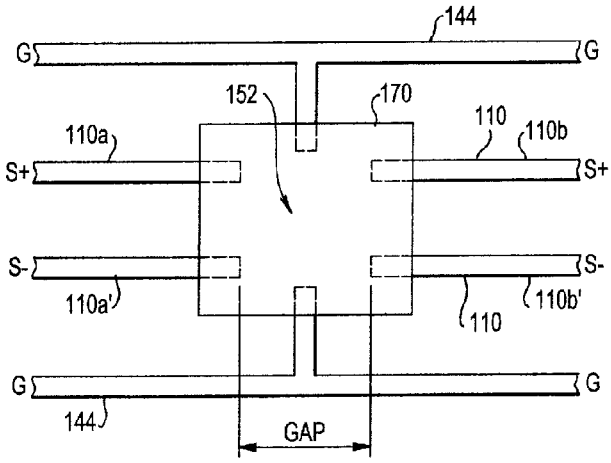
FIG. 11
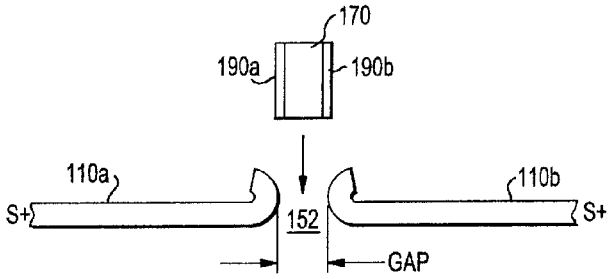
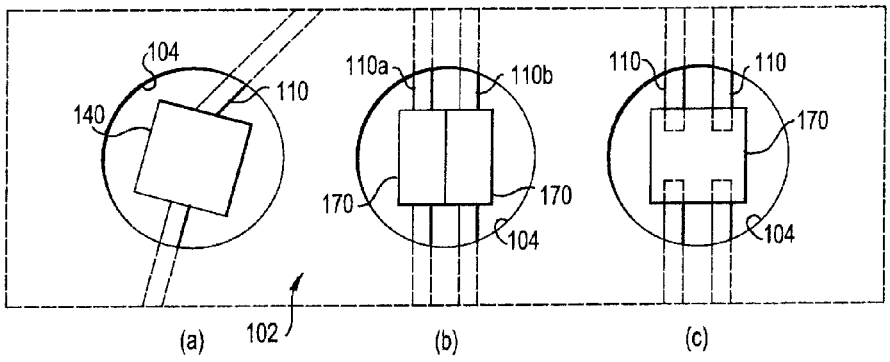
FIG. 12

ELECTRICAL CONNECTOR HAVING THICK FILM LAYERS

RELATED APPLICATIONS

This application is a continuation-in-part of Ser. No. 12/784,914, filed May 21, 2010, and claims the benefit of provisional application No. 61/367,291, filed Jul. 23, 2010, and provisional application No. 61/386,782, filed Sep. 27, 2010, the contents of which are incorporated herein by reference.

BACKGROUND OF THE INVENTION

This invention relates generally to an electrical connector incorporating passive circuit elements and methods of manufacturing such an electrical connector.

Modern electronic circuitry is often built on printed circuit boards. The printed circuit boards are then interconnected to create an electronic system, such as a server or a router for a communications network. Electrical connectors are generally used to make these interconnections between the printed circuit boards. Typically, connectors are made of two pieces, with one piece on one printed circuit board and the other piece on another printed circuit board. The two pieces of the connector assembly mate to provide signal paths between the printed circuit boards.

A desirable electrical connector should generally have a combination of several properties. For example, it should provide signal paths with appropriate electrical properties such that the signals are not unduly distorted as they move between the printed circuit boards. In addition, the connector should ensure that the two pieces mate easily and reliably. Furthermore, the connector should be rugged so that it is not easily damaged by handling of the printed circuit boards. For many applications, it is also important that the connector have high density, meaning that the connector can carry a large number of electrical signals per unit length.

Examples of electrical connectors possessing these desirable properties include VHDM®, VHDM®-HSD and GbX® connectors manufactured and sold by the assignee of the present invention, Amphenol Corporation.

One of the disadvantages of present electronic systems is the need, often times, to populate the surfaces of the interconnected printed circuit boards with passive circuit elements. These passive circuit elements, such as capacitors, inductors and resistors, are necessary, for example: (i) to block or at least reduce the flow of direct current ("DC") caused by potential differences between various electronic components on the interconnected printed circuit boards; (ii) to provide desired filtering characteristics; and/or (iii) to reduce data transmission losses. However, these passive circuit elements take up precious space on the board surface (thus reducing the space available for signal paths). In addition, where these passive circuit elements on the board surface are connected to conductive vias, there could be undesirable signal reflections at certain frequencies due to impedance discontinuity and resonant stub effects.

Examples of thick film devices are shown in U.S. Pat. No. 3,582,729 to Girard, U.S. Pat. No. 2,774,747 to Wolfson, and U.S. Pat. No. 2,397,744 to Kertesz. Polymer thick films are discussed in Polymer Thick Film by Ken Gilleo, ©1996, and Creative Materials, Inc. of Tyngsboro, Mass. (www.creative-materials.com) offers a High Dielectric Constant Ink as well as a Pad-Printable, High Dielectric Strength Ink/Coating. These documents are incorporated herein by reference.

What is desired, therefore, is an electrical connector and methods of manufacturing such an electrical connector that generally possesses the desirable properties of the existing connectors described above, but also provides passive circuit elements in the connector to deliver the desired qualities provided by the passive circuit elements described above. And it is further desired that such an electrical connector provide the passive circuit elements cost effectively.

SUMMARY OF THE INVENTION

The objects of the invention are achieved by an electrical connector that has signal conductors which are electrically connected by the use of one or more thick films applied over the conductors. The thick films can have resistive, conductive, insulative and/or lossy properties. The thick films form electrical circuits made up of resistors and/or capacitors, which operate on the signals being carried on the signal conductors. The conductors are on an insulative housing, and the thick films are sequentially applied to form the desired circuitry.

With those and other objects, advantages and features of the invention that may become hereinafter apparent, the nature of the invention may be more clearly understood by reference to the following detailed description of the invention, the appended claims and to the several drawings attached herein.

BRIEF DESCRIPTION OF THE DRAWINGS

The foregoing features of this invention, as well as the invention itself, may be more fully understood from the following description of the drawings in which:

FIG. 10 shows a circuit element on top of conductors in another embodiment of the invention;

FIG. 11 shows an elevation view of a circuit element in a pre-connected position relative to a signal conductor of the wafer;

FIG. 12 shows a plan view of a portion of the wafer of the daughtercard connector shown in FIG. 2;

DETAILED DESCRIPTION OF THE PREFERRED EMBODIMENT

Figure 1:
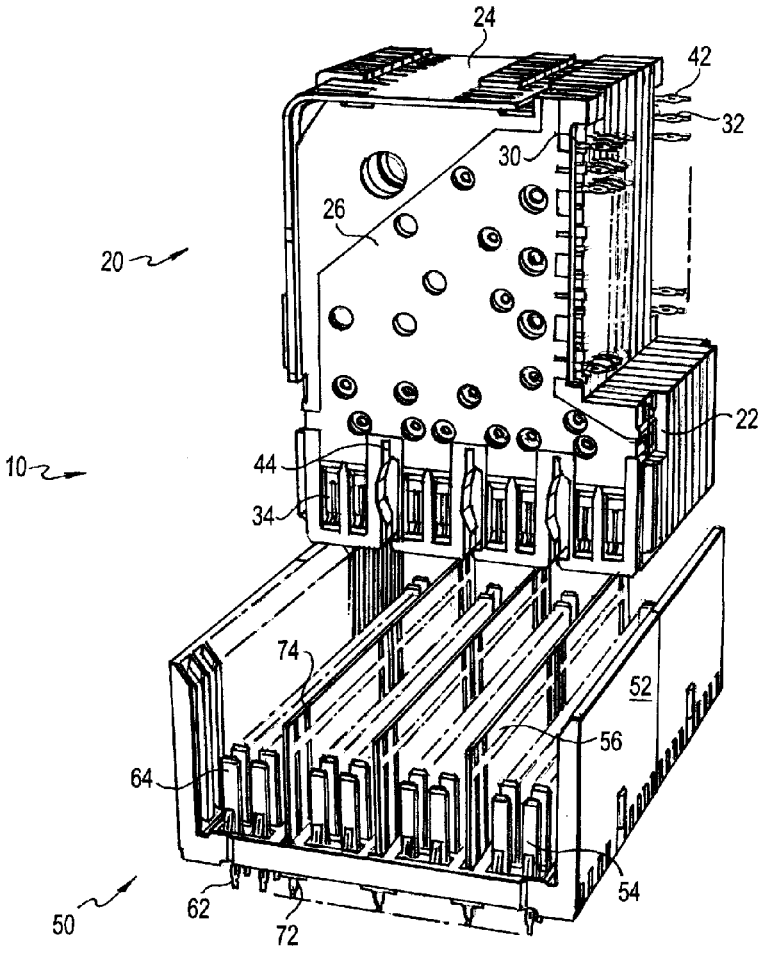
FIG. 1 (Prior Art)
FIG. 1 shows a perspective view of a prior art electrical connector assembly illustrated as FIG. 1 in U.S. Pat. No. 6,409,543, where the electrical connector assembly includes a daughtercard connector and a backplane connector.

Several preferred embodiments of the invention are described for illustrative purposes, it being understood that the invention may be embodied in other forms not specifically shown in the drawings.

FIG. 1 shows a perspective view of a prior art electrical connector assembly 10 illustrated as FIG. 1 in U.S. Pat. No. 6,409,543. The '543 patent, which is directed to the GbX® connector, is assigned to the assignee of the present invention and is incorporated by reference herein. The electrical connector assembly 10 includes a daughtercard connector 20 that is connectable to a first printed circuit board (not shown) and a backplane connector 50 that is connectable to a second printed circuit board (not shown). The daughtercard connector 20 has a plurality of modules or wafers 22 which are preferably held together by a stiffener 24.

Each wafer 22 includes a plurality of signal conductors 30, a shield plate (not visible in FIG. 1), and a dielectric housing 26 that is formed around at least a portion of each of the plurality of signal conductors 30 and the shield plate. Each of the signal conductors 30 has a first contact end 32 connectable to the first printed circuit board and a second contact end 34 mateable to the backplane connector 50. Each shield plate has a first contact end 42 connectable to the first printed circuit board and a second contact end 44 mateable to the backplane connector 50.

The general layers of the wafer 22 include an insulative housing layer, a shield plate with contacts layer, an insulative housing layer, conductors layer, and another insulative housing layer. That arrangement necessitates connecting to a ground (shield plate) of a different layer.

The backplane connector 50 includes an insulative housing 52 and a plurality of signal conductors 54 held by the insulative housing 52. The plurality of signal conductors 30, 54 are arranged in an array of differential signal pairs. The backplane connector 50 also includes a plurality of shield plates 56 that are located between rows of differential signal pairs. Each of the signal conductors 54 has a first contact end 62 connectable to the second printed circuit board and a second contact end 64 mateable to the second contact end 34 of the corresponding signal conductor 30 of the daughtercard connector 20. Each shield plate 56 has a first contact end 72 connectable to the second printed circuit board and a second contact end 74 mateable to the second contact end 44 of the corresponding shield plate of the daughtercard connector 20.

As discussed in the Background Of The Invention section, the electrical connector assembly 10 of FIG. 1 does not have passive circuit elements that would provide desirable characteristics, such as DC flow minimization, desired filtering characteristics or data transmission loss reduction.

Figure 2:
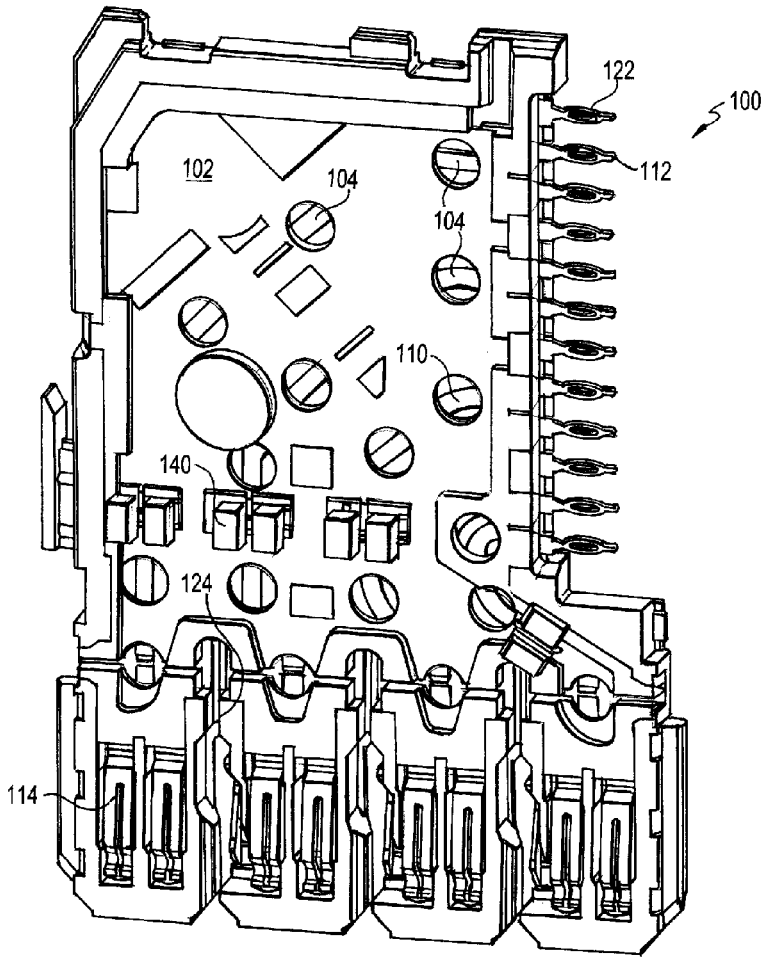
FIG. 2 shows a perspective view of a wafer of a daughtercard connector in accordance with the preferred embodiment of the present invention.

Referring now to FIG. 2, there is shown a wafer 100 of a daughtercard connector in accordance with the preferred embodiment of the present invention. The wafer 100 may be one of a plurality of such wafers that are held together by, for example, a stiffener, such as the stiffener 24 of FIG. 1. The wafer 100 includes a plurality of signal conductors 110 and an insulative housing 102. One or more openings 104 are provided in the insulative housing 102. Each opening 104 exposes a portion of at least one of the signal conductors 110. The signal conductors 110 are more clearly shown in FIG. 3, which illustrates the wafer 100 of FIG. 2 with a portion of the insulative housing 102 removed from the drawing. Note that the signal conductors 110 are arranged as differential signal pairs, with a first distance between signal conductors of a differential pair smaller than a second distance between signal conductors of adjacent differential pairs. However, it should be apparent to one of ordinary skill in the art reading this specification that the present invention and its concepts can be applied equally as well to single-ended signal connectors.

Each signal conductor 110 has a first contact end 112, a second contact end 114 and an intermediate portion 116 therebetween. The intermediate portion 116 of the signal conductor 110 is disposed within the insulative housing 102. Preferably, the wafer 100 also includes a ground conductor member or a shield plate having a first contact end 122 and a second contact end 124. The configuration of the shield plate may be similar to the shield plate of FIG. 1. The first contact ends 112, 122, which are illustrated as press-fit "eye of the needle" contact ends, are connectable to a first printed circuit board (not shown). The second contact ends 114, 124 are connectable to a mating connector (not shown), such as the backplane connector 50 of FIG. 1. Although the first contact ends 112, 122, are shown as press-fit eye of the needle contact ends, they may instead be configured to be electrically connected to any suitable electrical cable, such as, but not limited to, a flat ribbon cable. It will also be appreciated by those skilled in the art that the longitudinal axes of the first and second contact ends 112, 114 do not have to be oriented at right angles to each other, but could be oriented at any suitable angle.

Attached to the intermediate portion 116 of each signal conductor 110 is a passive circuit element 140. Preferably, the passive circuit element 140 includes at least a capacitor, resistor, or an inductor, which may be housed in an insulative package 138 and is, for example, a commercially available off-the-shelf component. For example, if the passive circuit element 140 is desired to function as a direct current blocking circuit, then one of the ceramic or tantalum chip capacitors that are sold by KEMET Electronics Corporation of Greenville, S.C., may be utilized. The technical information for these ceramic or tantalum chip capacitors are available from KEMET (www.kemet.com) and are incorporated by reference herein. If the passive circuit element 140 is desired to function as a high frequency passive equalization circuit, then one of the resistor/inductor/capacitor packages that are sold by Maxim Integrated Products, Inc. of Sunnyvale, Calif. may be utilized. The technical information for these packages are available from Maxim (www.maxim-ic.com) and are incorporated by reference herein. It should be noted that while the preferred embodiment is directed to a two-piece (daughtercard connector and backplane connector), shielded, differential pair connector assembly, the concepts of the invention are applicable to a one-piece connector, an unshielded connector, a single-ended connector or any other type of electrical connector. The circuit element 140 may also be an active circuit element connected to a power conductor (described below). For instance, the circuit element 140 may be a filter, common mode filter, high frequency coupler, or a high frequency transformer.

Figure 4:
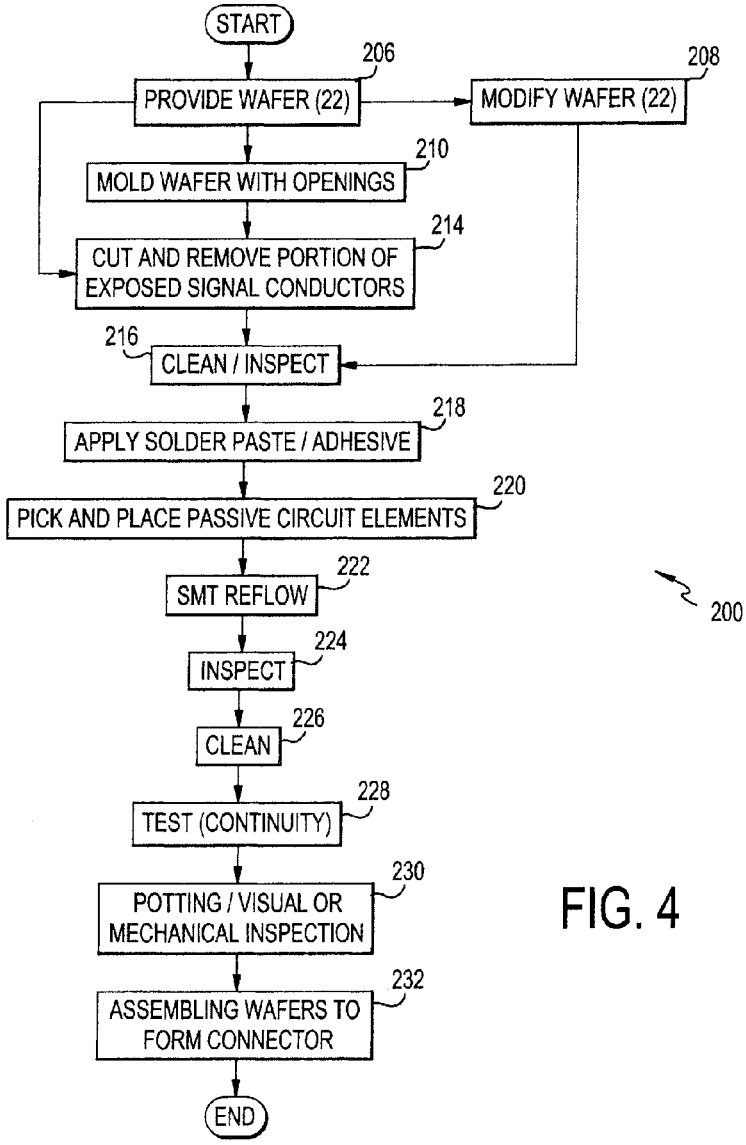
FIG. 4 shows a flowchart of a preferred manufacturing process for the connector in accordance with the present invention.

Referring now to FIG. 4, there is shown a flowchart 200 of a preferred manufacturing process for a connector in accordance with the present invention. This flowchart 200 illustrates the process steps for modifying and adapting an existing connector, such as the daughtercard connector 20 of FIG. 1, to provide the desirable passive circuit elements. It should be apparent to one of ordinary skill in the art that as the various process steps of the flowchart 200 are described, some of the steps need not be included in order to manufacture a connector in accordance with the present invention. Furthermore, the sequence of some of the steps may be varied.

The process steps of the flowchart 200 may be implemented beginning with Step 206 in one embodiment of the present invention, or with Step 210 in another embodiment of the present invention. Step 206 describes providing an already assembled connector (e.g., daughtercard) having one or more wafers that are to be modified in step 208 to create an insulative housing 102 around the plurality of signal conductors 110 in the wafers, and to include openings defined through which an exposed area of each of the signal conductors 110 are accessible.

Figure 3:
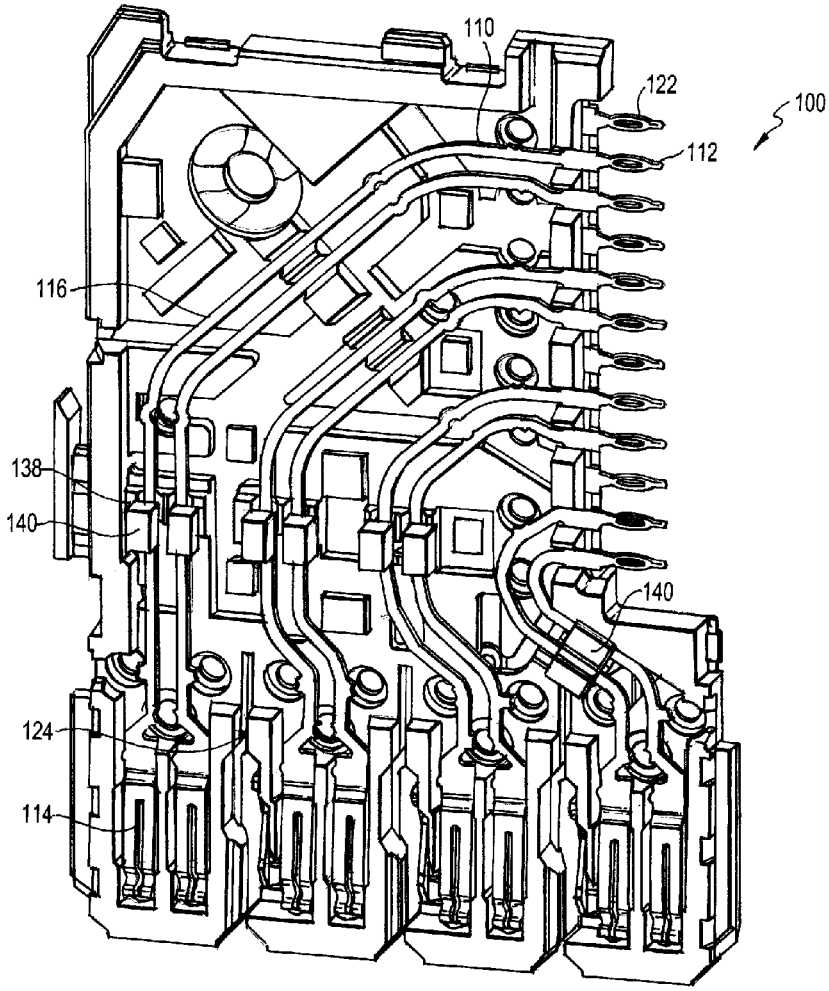
FIG. 3 shows a perspective view of the wafer of FIG. 2, with a portion of an insulative housing removed from the drawing to better illustrate attachment of passive circuit elements to signal conductors of the wafer.

Generally speaking, the signal conductors 110 shown in, for example FIG. 3, are stamped from a flat metal sheet along with bridge pieces or tie bars (not shown) to hold the conductors in position during subsequent processing steps, including during the step when plastic is shot around the conductors. In the process shown in FIG. 4, for example, one starts with metal stamping. Ground conductors cannot, in the final product, be shorted together; therefore, once they are fabricated by stamping as noted above, the bridge pieces/tie bars are removed after the conductors are molded in place. Then if a gap 152 in the signal conductors 100 is needed (as shown, for example, in FIG. 5) for insertion of components, the gaps are formed. The insulative housing is formed using this same plastic overmolding process.

Figure 6:
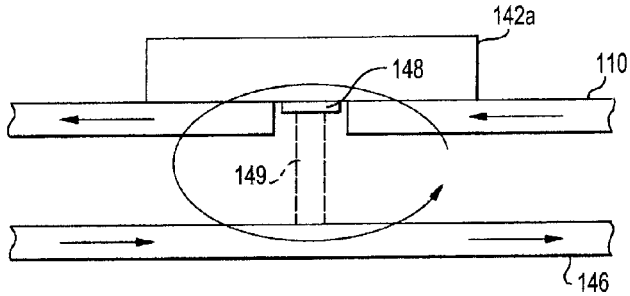
FIG. 6 shows a circuit element coupling a differential pair of signal conductors according to an embodiment of the present invention, with a preferable gap or break in the conductors.

The flat metal sheet may also be stamped such that, as shown in FIG. 6, an optional T- or L-shaped conducting connecting member 149 is provided which extends approximately perpendicular to the plane of the ground conductor 146 for attachment to a pad 148 located on the circuit component 142*a*. The conducting connecting member 149 could also extend approximately perpendicular to the ground conductor 146 in a different plane depending upon the orientation of the ground conductor 146 relative to the signal conductor 110 and circuit component 142*a*. That is, instead of extending upward as shown in FIG. 6, it would extend into the page at an angle that is 90-degrees relative to the direction shown in the figure in order to accommodate the ground conductors 146 being placed substantially co-planar with the conductors 110 and circuit element 142*a*.

Electrical coupling occurs when a current loop between the circuit element 142*a*, the signal conductor 110, and the ground return conductor 146 of one signal conductor, becomes coupled to a similar current loop in a second, nearby circuit element/signal conductor/ground. That is, as shown in FIG. 6, when signal leads extend over conductors, and with a component circuit element 142*a* on top of the conductors, a local induced magnetic field forms a current loop. When the circuit element 142*a* is moved further away from the ground return conductor 146, the current path through the circuit element 142*a* is also farther from the ground 146. When this happens, the area of the current loop associated with the circuit element 142*a* is larger, which produces a larger self inductance of this element and increased mutual inductance between this circuit element 142*a* and nearby circuit elements.

Alternatively, if an already assembled connector is not provided, Step 210 shown in FIG. 4 describes providing a wafer, such as a wafer 22 of FIG. 1. At Step 210, during the molding of the insulative housing around the plurality of signal conductors, openings 104 are defined, through which an exposed area of each of the signal conductors 110 is accessible. Preferably, the openings 104 are provided adjacent the intermediate portions 116 of the signal conductors 110. Note that the plurality of signal conductors 110 are preferably stamped from a lead frame, as is known in the art. Typically, the signal conductors 110 are made of a solder wettable material, such as beryllium-copper or the like, and intermediate portions 116 of the signal conductors 110 may be coated with nickel or other non-solder wetting material. In this case, the exposed area of the signal conductors is provided with solder wettable material, such as tin-lead coating.

Figure 5:
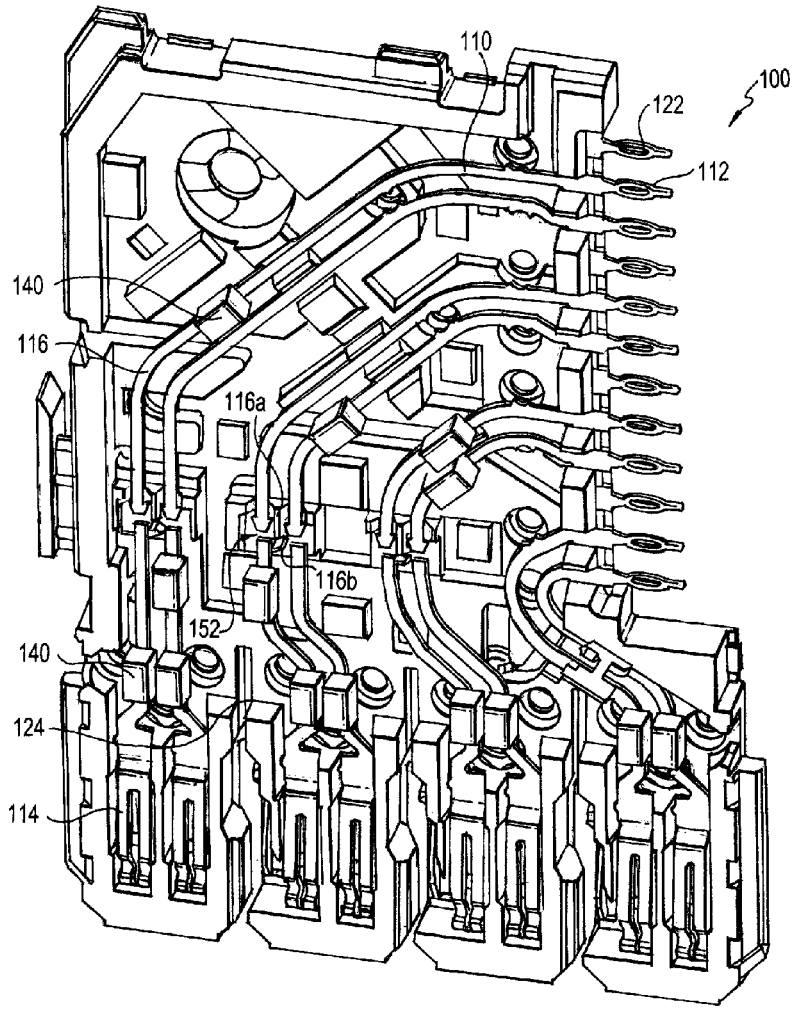
FIG. 5 shows a perspective view of the wafer of FIG. 3, with some of the passive circuit elements removed from the drawing to better illustrate portions of the signal conductors to which the passive circuit elements are attached.

Step 214 describes cutting and removing a portion of the exposed area of the signal conductors 110 to provide a gap 152 in the signal conductors 110, so that only a portion of the exposed area remains. FIG. 5 is a another view of the wafer 100 of FIG. 3, with two of the passive circuit elements 140 removed to show the remaining portions 116*a*, 116*b* of the exposed area of the signal conductors 110. The remaining portions 116*a, b* are the ends sections of the conductors 110 that are formed when the gap 152 is created. Step 216 describes cleaning and inspecting the signal conductors 110 after the cutting and removing step 214. This step can be performed manually or automatically, and can be bypassed if desired.

Step 218 describes applying solder paste or conductive adhesive to the remaining portions 116*a*, 116*b* of the exposed area of the signal conductors 110. Step 220 then describes picking and placing passive circuit elements 140 onto the remaining portions 116*a*, 116*b* of the exposed area of the signal conductors 110. Note that the openings in the insulative housing described in step 210 are sized to receive the passive circuit elements 140. And step 222 describes conventional SMT reflow to securely attach the passive circuit elements 140 to the remaining portions 116*a*, 116*b* of the exposed area of the signal conductors 110. While the preferred method of step 218 is to apply the solder paste or conductive adhesive to the remaining portion 116*a*, 116*b* of the exposed area of the signal conductors 110, it should be apparent to one of ordinary skill in the art that the solder paste/conductive adhesive may instead be applied to the passive circuit elements 140 or to both the remaining portion 116*a*, 116*b* of the exposed area of the signal conductors 110 and the passive circuit elements 140 as desired.

Steps 224 and 226 respectively describe inspecting and cleaning the attachment area around the passive circuit elements 140 and the remaining portions 116*a*, 116*b* of the exposed area of the signal conductors 110. Steps 228 and 230 respectively describe testing for electrical continuity across the attachment area and potting/visual or mechanical inspection as required. Finally, step 232 describes assembling a plurality of wafers 150 to form a connector in accordance with the preferred embodiment of the present invention.

While the flowchart 200 illustrates cutting and removing a portion of the exposed area of the signal conductors 110 (step 214) after the insulative housing has been molded around the plurality of signal conductors, it is certainly possible, and in some cases even preferable, to cut and remove the portion of the exposed area of the signal conductors before the insulative housing has been molded around the plurality of signal conductors. The molded insulative housing will define openings through which the remaining portion of the exposed area of the signal conductors will be accessible.

In an alternative manufacturing process (not shown) for a connector in accordance with the present invention, a passive circuit element (preferably a capacitive element) may be provided as follows: (i) providing a first lead frame which includes a plurality of first signal conductors, with each of the plurality of first signal conductors having a first contact end and an intermediate portion; (ii) providing a second lead frame which includes a plurality of second signal conductors, with each of the plurality of second signal conductors having a second contact end and an intermediate portion; (iii) positioning the plurality of first signal conductors and the plurality of second signal conductors adjacent one another such that for each first signal conductor there is a corresponding second signal conductor adjacent thereto; (iv) attaching at least a segment of the intermediate portion of each first signal conductor to at least a segment of the intermediate portion of the corresponding second signal conductor with a dielectric material provided therebetween so as to provide a capacitive element; and (v) providing an insulative housing around at least a portion of each of the plurality of first and second signal conductors. In this process, the attached intermediate portions of the first signal conductor and the second signal conductor serve as capacitive plates to provide the desired capacitive characteristics. Other applicable steps from FIG. 4 can then be utilized as needed.

Figure 7:
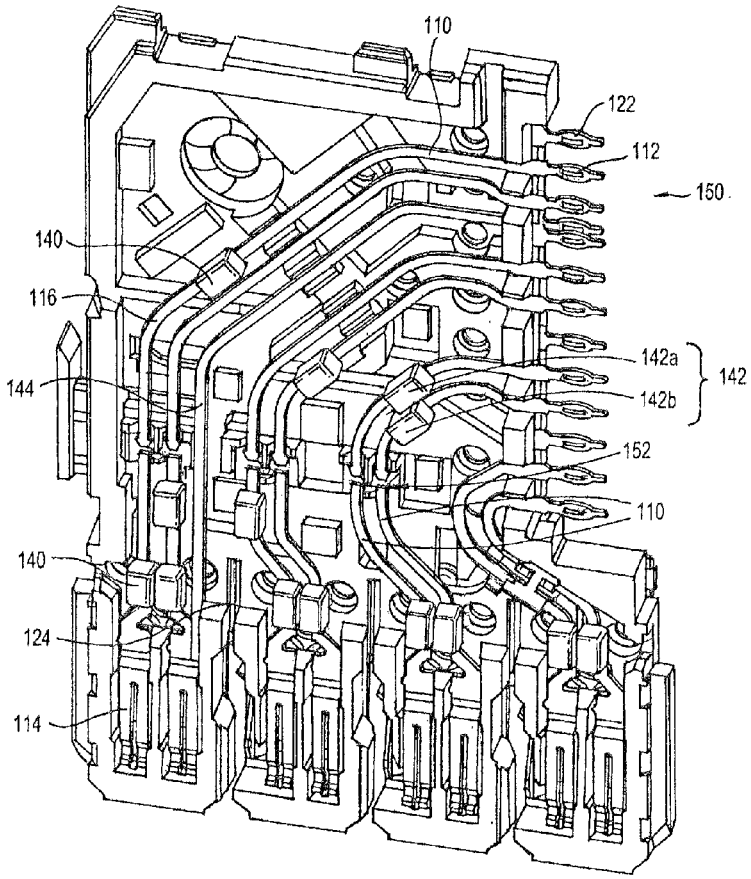
FIG. 7 shows a wafer having a power conductor.

Referring to FIG. 7, there is shown a perspective view of a wafer 150 of a daughtercard connector in accordance with another embodiment of the present invention. The wafer 150 may be one of a plurality of such wafers that are held together by a stiffener, such as the stiffener 24 of FIG. 1. The wafer 150 of FIG. 7 is similar to the wafer 100 of FIG. 2, with the substantive difference being the presence of additional passive circuit elements 140 along the intermediate portions 116 of the signal conductors 110. Note that in the wafer 150 illustrated in FIG. 7, all but two signal conductors that are shortest in length are provided with two passive circuit elements 140 each. In some simulations, it has been shown that having additional passive circuit elements 140 provides better desired qualities, such as high frequency passive equalization. It should be noted that the desirable number of passive circuit elements 140 is not limited to one or two per signal conductor, but rather depends on various other factors, including the structure and electrical characteristics of the connector. Thus, more than two passive circuit elements 140 can be provided.

As further shown, a pair of passive circuit elements 142*a, b* are provided on the differential signal conductor pairs 110. The passive circuit element pairs 142*a, b* are shown juxtaposed next to each other but also spaced slightly apart from one another along the longitudinal axis of the respective signal conductors 110 to which they are connected. That is, the pair of circuit elements 142*a, b* are not aligned directly next to each other (like the passive circuit elements shown at the bottom of the embodiment). Rather, the pair of passive circuit elements 142*a, b* are staggered slightly apart, as shown, to reduce the effects of electrical coupling.

Figure 8:
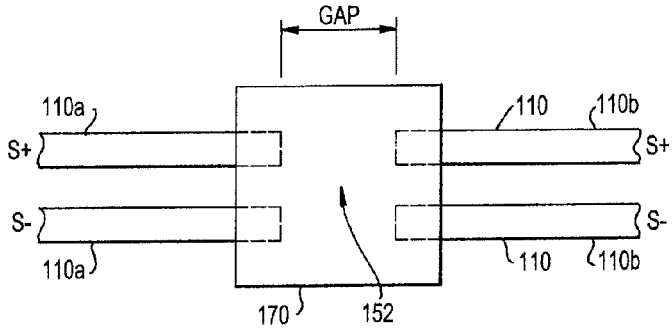
FIG. 8 shows a circuit element coupling a differential pair of signal conductors according to another embodiment of the present invention.

Following along from one end of one of the conductors 110 of the conductor pair, from the first contact end 112 to the second contact end 114, there is shown two passive circuits 140 in two locations, and at least one gap along the conductor 110 that does not have a passive circuit element 140. If the wafer 150 is to be fabricated without any components 140, the conductor pairs 110 would not have any gaps 152. However, if components 142 are to be included, the gap 152 is formed along the length of at least one of the conductors 110 of the conductor pair and the components 142 are soldered across the gap 152 (it could also be soldered in such a way that it connects across side-by-side gaps located in both of the conductors of the conductor pair, i.e., by connecting with four, rather than just two, leads). The passive circuit elements 142*a, b* could be replaced with a single passive circuit element 170 (as best seen in FIG. 8) that connect across both conductors 110.

Though only elements 142*a* and 142*b* are shown staggered, one or more of the other passive circuit element pairs shown in FIG. 7 can also be staggered to reduce the effects of electrical coupling. However, the pair must not be staggered too far apart, because then the circuit elements will not be balanced. The optimal distance is about one-half to one length of the circuit element, depending on a given wafer 100 configuration.

FIG. 7 illustrates an embodiment of the invention in which a ground conductor plate is separated from respective signal conductors 110 for shielding purposes (press-fit contact end 122 is attached to the ground conductor plate). Thus, the signal conductors 110 are positioned substantially side-by-side and substantially co-planar over the ground conductor plate.

FIG. 7 also shows the use of an alternative conductor 144 having first and second ends, which can carry power or can be a ground contact between the operable connection ends of the wafer 150. The alternative conductor 144 only needs to be provided on one side of the wafer 150. However, the location of the conductor 144 is exemplary and can be any suitable location on the wafer 150. More than one conductor 144 can be provided, and the conductor 144 need not extend the entire length of the wafer 150. In the case of the conductor 144 that carries power or provides a ground, the break 152 may not be necessary or desired.

Referring to FIG. 8, power may also be provided by having phantom direct current power on the s+ and s− conductor leads of the conductors 110. That is, the pair s+, s− have a gap or break, and a passive circuit element 170 that needs power bridges that gap. Another way to understand the phantom direct current power arrangement is to use signal conductors s+, s− and a signal frequency greater than about 1 MHz combined with a DC supply power voltage between s+ and s− to provide power on one side of the circuit element 170, such that, if the circuit elements 170 are insensitive to DC voltage, a DC voltage across the circuit element 170 would be formed (e.g., a signal coming from conductor 112, the s+ and s− would have simultaneous sum of two voltages: one exclusively above 1 MHz plus one to supply power, the circuit elements 170 would modify the signal but use the DC voltage for power but not pass along to the other end 114.

Referring momentarily back to FIG. 7, every third terminal contact, counting down from the press-fit contact which is labeled as 122 (not including the alternative conductor 144), connects to the ground plate below the conductors 110 and the passive circuit components 142. This allows the ground conductors 122 to be co-planar underneath the pair of circuit conductors and be ground to a ground plate. An alternative is to use the alternative conductor 144, or multiple conductors 144, positioned next to the pairs of signal conductors 110. The alternative conductors 144 may carry power or be ground conductors. If the alternative conductors 144 are ground conductors, a ground plate and the press-fit ground contacts 122 would not be needed. Because the alternative conductors 144 are more or less in the same plane as the passive circuit components 142 and the signal and ground conductors 110, the passive circuit components 142 can be attached to the wafer 150 relatively easily.

However, if the need exists to use the ground plate, a T-shaped or L-shaped conductor member 150 extending up from the ground plate could be used, as discussed and shown with respect to FIG. 6. Thus, returning to the embodiment shown in FIG. 8, the bottom ground plate G could be a plate with a projection extending up to and connecting with the bottom of the circuit element 170 (i.e., using a voltage pin; not shown), or if no bottom ground plate G is present, a narrow conductor connecting the ground contacts 122 running next to signal pairs 110 could be used. In the embodiment shown in FIG. 8, a voltage power conductor v+ and a ground conductor can be added. The ground plate G could be co-planar with the separate ground conductors.

The circuit element 170 shown in FIG. 8 is another aspect of the present invention in which the passive circuit element is electrically connected to a pair of signal conductors 110. Preferably, the circuit element 170 spans the gap 152 in the signal conductors, which electrically separates the signal conductors 110 into first and second segments 110*a*, 110*b*. The gap 152 between two successive sections of the same conductor or between sections of two adjacent conductors may be fabricated by stamping or other techniques.

Figure 9:
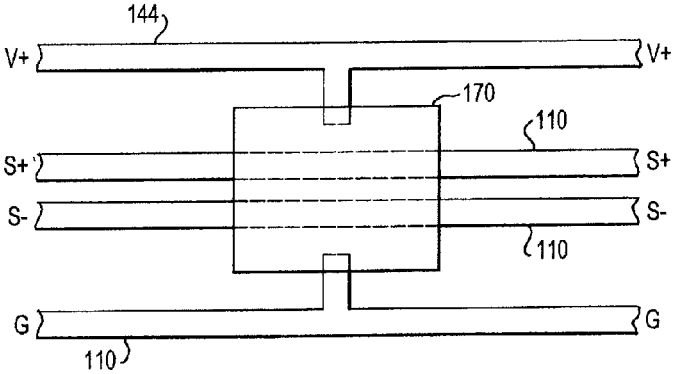
FIG. 9 shows a circuit element coupling a differential pair of signal conductors according to one embodiment of the present invention, optionally without the gap or break in the conductors.

Referring to FIG. 9, the signal conductors 110 are shown side-by-side with circuit element 170 (as in FIG. 8), but in addition to conductor plate G below those elements, a co-planar power conductor 144 is provided on one side of the circuit element 170 that attaches to the side or bottom of the circuit element 170. Alternatively, the ground conductor plate G could be replaced with another conductor 144 to balance the other conductor such that they are co-planar. This type of side-by-side conductor arrangement is particularly useful for higher speeds.

The circuit element 170 may be a passive or active circuit element. A single passive circuit element covers s+ and s− leads, which usually have a break or gap 152, but they may also be continuous leads as shown. If powered, the circuit element 170 is electrically connected to the power conductor 144 and to ground 110, as shown (though the element 170 can be powered in other suitable ways). In the embodiment shown, the circuit element 170 connects a pair of signal conductors 110. The ground conductor 110 is on the shielded plate, and therefore must extend through the insulative housing 102. Alternatively, the ground conductor 110 can be provided on top of the insulative housing 102, similar to the power conductor 144. When the ground conductor G is provided in the same plane with the signal conductors s+ and s− 110 (the pair conductors over a planar ground return, the co-planar conductor(s) are peripherally on one or both sides), the arrangement has certain benefits. For instance, the spacing can be maintained more accurately because it is stamped from a plate using a die, and also because if components are to be attached to all leads, it is much easier to attach components when everything is in the same plane. Also, if a ground is in the plate, a lead would be in the same plane.

Although the gap 152 in the signal lines 110 is not provided in FIG. 9, another configuration is with the signals 110 having the gap 152. For example, as shown in FIG. 10, an exemplary circuit element 170 according to another aspect of the present invention is shown. In this embodiment, a passive circuit 170 is electrically connected to two signal conductors 110, and to two ground conductors 144 (which alternatively may be the shield plate 122). The circuit element 170 spans or bridges the gap 152 in the signal conductors s+ and s− 110. The circuit element 170 also spans or bridges a break in the ground conductors 144. The gap 152 electrically separates the signal conductor 110 into first and second segments 110*a*, 110*b*. Thus, there may be up to six terminals: s+, s−, s+, s−, G (proximate one side), and G (proximate another side). The benefit of the arrangement shown is that a differential filter, direct current sourcing, and reflection reducing or impedance matching characteristics are all packaged in the circuit element 170, which may be an electrical component generally, or more specifically, an active or passive filter component providing one or more functions such as an equalizer or EMI filtering. Another benefit is that the ground connections are symmetrically arranged.

Alternatively, the circuit element 170 could extend up and over and overlap with the ground conductors 144 to enable an attachment of the ground conductors 144 to a pad 148 (FIG. 6) on the bottom of circuit element 170. Also, power could be supplied as a DC voltage between s+ and s−, or between s+, s−, and the grounds.

It will be appreciated by those skilled in the art that the signal conductors 110 do not have to be linear at the point where the circuit element is attached, as illustrated thus far, but may instead include bends along the length of the signal conductors. Moreover, the gaps 152 between the first and second segments of a signal conductor may be such that the longitudinal axis of each segment is not perfectly coaxial. In addition, more than one circuit element 170 can be provided in any connection configuration (FIGS. 6, 8, 9, 10).

Turning to FIG. 11, there is shown another alternative configuration for the circuit element 170 to connect to the two leads of a signal conductor 110, in which the circuit element 170 has connection portions 190*a*, 190*b*. The circuit element 170 is shown in an unconnected position. As indicated by the arrow, the circuit element 170 is moved into the gap 152 between the signal conductor segments 110*a* and 110*b*. In the connection position, the circuit element 170 is between the segments 110*a, b*, which completes the electrical circuit for the signal conductor 110. The leads of the signal conductor segments 110*a* and 110*b* are turned up so that the circuit element 170 is received in the gap 152 without stubbing. The connection portions 110*a*, 110*b* may be a resilient spring, a lance, a cantilevered flange, a pin, or the like, which creates a secure, but reversible, friction fit when the circuit element 170 is in the connected position. The mechanical connection portions 110*a*, 110*b*, could instead be a conductive adhesive that secures the circuit element 170 in the connected position. The conductive adhesive is, preferably, one that has a melt point at least higher than the temperatures that the adhesive is exposed to during the manufacturing of the wafer 100 (i.e., the temperature of, for example, reflow soldering).

Referring now to FIG. 12, there is shown a portion of the insulative housing 102 as seen in FIG. 2. The insulative housing includes several openings 104 that expose the signal conductors 110 of the wafer 100. The openings 104 may be used to provide a relatively flat and/or clear insulative area of potential connection for circuit elements 140 to be connected to the signal conductors 110. Various configurations of opening 104, signal conductor(s) 110, circuit element 170, and gaps 152 between segments of signal conductors 110 are shown in FIG. 12. For example, the opening 104 shown in FIG. 12(*a*) is large enough to include a single conductor 110 and a single circuit element 140. The opening 104 shown in FIG. 12*b* is large enough to include two signal conductors 110*a*, 110*b*, each with a respective circuit element 170. The circuit elements 170 do not have to be positioned next to each other as shown, but could instead be spaced apart along the longitudinal axis of the signal conductors 110*a*, 110*b*, respectively, in order to reduce the effects of coupling. The opening 104 shown in FIG. 12*c* includes four terminals exposed in the opening 104 that are electrically connected by the circuit element 170. The opening 104 is constructed so as to be adapted for screen printing or other application of one or more patterns and or layers of resistive, conductive, dielectric, or magnetically permeable materials in the form of a thick film or thin film or individual pieces. A laser or other trimming process may be used to adjust the resulting component values to achieve desired characteristics.

Figure 13:
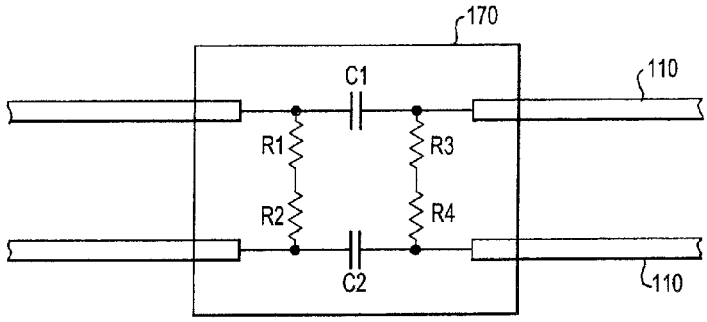
FIG. 13 shows a circuit element coupling two differential pairs of signal conductors according to another embodiment of the present invention.
Figure 14:
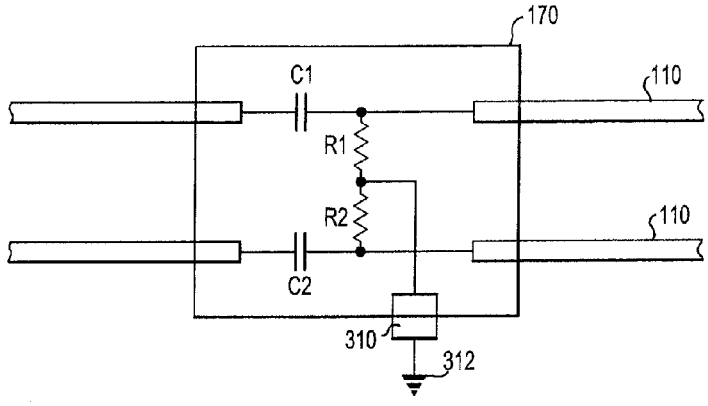
FIG. 14 shows a circuit element coupling two differential pairs of signal conductors according to yet another embodiment of the present invention.

Referring to FIG. 13, a circuit element 170 is electrically connected to two signal conductors 110. The circuit element 170 is a passive circuit element containing two capacitors $C_1$ and $C_2$ and resistors $R_1$ through $R_4$. Resistors $R_1$ and $R_2$ could be combined into a single resistor; and resistors $R_3$ and $R_4$ could be combined into a single resistor. One function of such resistors is to provide DC current paths between positive and negative signals. Alternatively, to provide impedance matching to reduce reflections of signals, $R_1$ and/or $R_3$ could be replaced by an inductor. FIG. 14 shows another circuit element 170 that is electrically connected to two signal conductors 110. The passive circuit of the circuit element 170 includes two capacitors $C_i$ and $C_2$, two resistors $R_1$ and $R_2$, which resistors connect to a ground reference conductor 312 by means of a ground tab or terminal 310.

As noted above, electrical coupling can be a problem when circuit elements of an interconnection device like the wafer 100 of the present invention are in close proximity to each other. One method of reducing the coupling effect is to stagger the circuit elements 170. However, it is desirable to further reduce undesirable coupling between distinct pairs of signals. Each differential pair of signals in an interconnection device effectively carries its own virtual ground plane with it due to cancellation effects. The incorporation of a lossy material positioned between one differential pair of signal conductors and a second such differential pair, whether or not there are any grounded conductors or ground shield either adjacent to those pairs of conductors or anywhere within the interconnection device, further reduces the coupling effect.

Figure 15A:
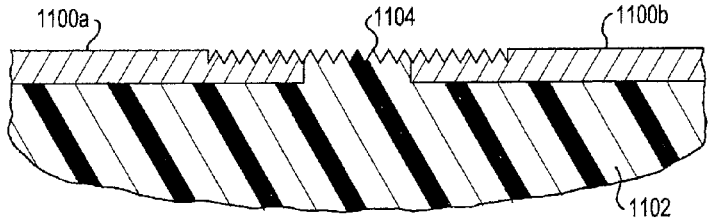
FIG. 15A shows a partial cross-sectional elevation view of signal conductor segments that are positioned on a portion of an insulative housing according to one embodiment of the present invention.
Figure 15B:
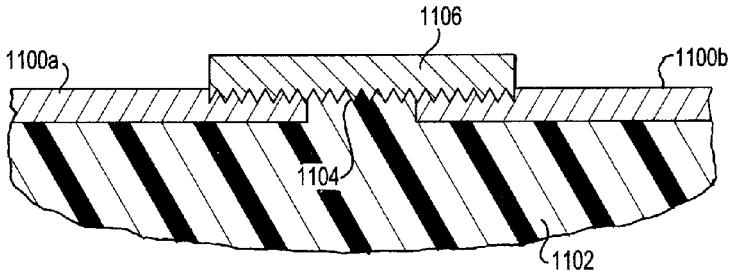
FIG. 15B shows the partial cross-sectional elevation view of FIG. 15A having an applied thick film.
Figure 15C:
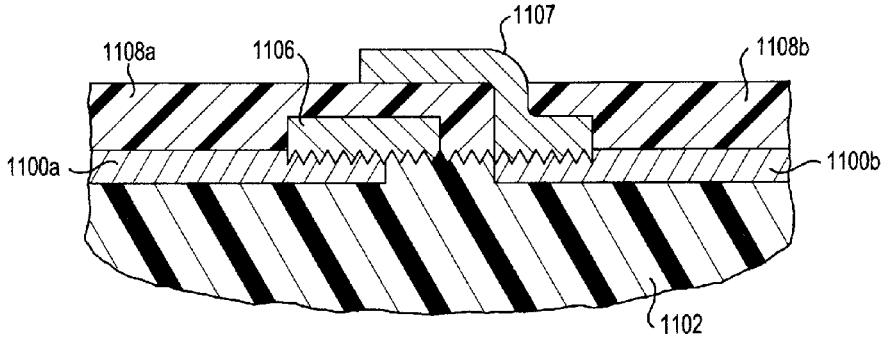
FIG. 15C shows another partial cross-sectional elevation view of signal conductor segments and an applied thick film according to a another embodiment of the present invention.

Referring to FIGS. 15A-C, various configurations of the circuit elements and the signal conductors are shown during manufacturing, before and after the addition of various thick film lossy, insulative, or conductive material features. FIG. 15A shows a partial cross-sectional elevation view of the signal conductor segments or elements 1100*a* and 1100*b* that are positioned on a portion of an insulative housing 1102. The conductor elements 1100*a, b* are separated to form a gap or spacing 1105 therebetween, which is filled by the insulative housing 1102.

A portion of the surface of the signal conductor segments 1100*a*, 1100*b* and/or housing 1102, is fabricated or manipulated in such a way as to create a roughened or grooved surface 1104, which is then capable of better accepting and retaining a coating of a thick film 1106 as shown in FIG. 15B. One method of creating such a roughened or grooved surface 1104 is to form the insulative material 1102 by insert molding it over a conductor leadframe incorporating elements 1100*a* and 1100*b*. Appropriate roughened or grooved features are provided on the surface portion of the steel insert mold assembly that presses down on the upper surface of the insulative housing 1102 and the conductors 1100*a*, 1100*b*, to form the roughened surface 1104, as shown in FIG. 15A. In this manner, a desired type of rough surface may be formed on the insulative housing 1102 by the molding process, and a same or different type of rough surface feature may be formed on the conductors 1100*a* and 1100*b* by the clamping pressure of the steel mold surface on the typically softer copper alloy conductors 1100*a*, 1100*b*.

Figure 15D:
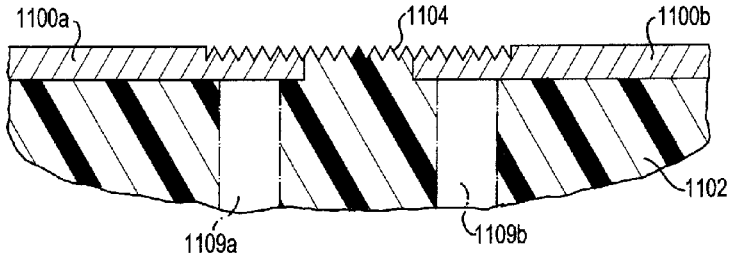
FIG. 15D shows a cross-sectional view of signal conductor segments having pins to support the conductors segments.
Figure 16:
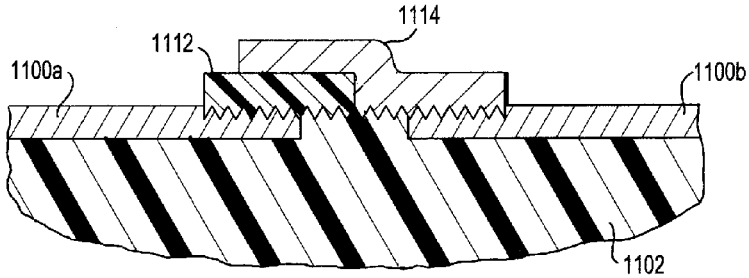
FIG. 16 is a cross-sectional view of another embodiment of the invention having two thick film layers.

In this case, with reference to FIG. 15D, steel core pins 1109*a, b* or other features can be provided in the insert mold that extend up through the insulative housing 1102 to support a portion of the underside of the conductors 1100*a*, 1100*b*. As shown in FIG. 15B, the entire surface to which the thick film layer 1106 is to be applied can be roughened. Or, as shown in FIG. 16, only a portion of the surface to which the thick film layers 1112, 1114 is to be applied, can be roughened.

The length, width, and thickness of the thick film 1106 can be configured to achieve a desired level of resistance for the thick film 1106 (FIG. 15B). In addition, the thick film 1106 may be etched, notched, ablated or otherwise removed to achieve the desired level of resistance along the length of the thick film 1106 material. FIG. 15C shows another configuration of thick films 1106, 1107 relative to the two signal conductor segments 1100*a*, 1100*b*, and an insulative layer 1108. This configuration may be utilized to construct a series capacitor circuit element connecting the two conductive elements 1100*a* and 1100*b*. The thick film elements 1106, 1107 are conductive thick films which overlap in a middle region but are separated and insulated from each other by a portion of insulative thick film material 1108. The configuration shown may be formed by successive printing or laying down of multiple layers and patterns of the insulative thick film 1108 and the conductive thick films 1106, 1107. For instance, by applying the thick film 1106, then layer 1108*a*, then layer 1107, then layer 1108*b*. In a similar fashion, a shunt resistive or capacitive connection may be formed between two parallel conductive signal paths by the use of thick film elements, analogous to the R1 and R2 of FIG. 14 which bridge between the two conductors 110 at the right of this figure.

The thick film 1106 is preferably a lossy material, including a lossy conductor material such as carbon or a carbon-particle-filled polymer resin matrix. In any case, it is not necessary that a high conductivity type of thick film material, such as one with a silver filler, be used for the thick film conductive elements. The resistivity of a lossy material is preferably between 10-1,000 ohms per square, and a conductive material would be between 0.01-1.0 ohm per square. A lossy dielectric, such as a lossy polymer resin, or a lossy magnetic material, such as ferrite or ferrite-particle-filled polymer resin matrix, may also be used. The use of a lossy conductor for 1106 or a lossy dielectric insulator for 1108 can provide the advantage of damping out undesirable high frequency resonant modes that may occur when the size of the physical capacitor formed will exceed approximately one-quarter of a wavelength of a frequency component an electrical signal passing through this device. Alternatively, a multi-layered capacitor structure may be built up in a similar fashion using successive applications and curing of suitable thick film materials of alternating insulative and conductive types.

Another application of the cross-sectional configuration of FIG. 15B or 15C would be to create a controlled degree of lossy coupling between conductor 1100*a* and conductor 1100*b*, which in this case would be viewed as running into and out of the plane of the figure, and in this case these conductors could be either both ground or shield conductors, or both independent signal conductors, or two halves of a differential pair of conductors, or one a signal conductor and one a ground conductor.

As an alternative to the use of a lossy material, shield, shield plates, or other shield contacts or conductors fabricated from high-conductivity metallic or other material which has from about 10 to 100-percent of standard pure copper's conductivity, can be used. However, such highly conductive shields can have higher costs, create undesirable cavity resonances, or radiation or crosstalk characteristics, and the need to connect such shields to other ground conductors in the parts of the wafer 100 that are joined together by the wafer 100. The lossy material avoids those disadvantages.

Additional thick film circuit configurations are shown in FIGS. 16-20. Turning to FIG. 16, a first layer 1112 which is insulative, can be formed along at least a portion of a first conductor element 1100*a*. A second layer 1114 can be formed along at least a portion of the second conductor element 1100*b* and extend over the first layer 1112 in the space between the elements 1100*a, b* over the insulative housing 1102. The second layer 1114 can be a good conductor, in which case the configuration forms a series capacitor between the second layer 1114 and the first conductor element 1100*a*. Or, the second layer 1114 can be resistive, in which case the configuration forms a capacitor and resistor in series with the conductor elements 1100*a, b*. Or, the insulating material 1112 can have a high dielectric constant (loaded with a high dielectric ceramic material), to provide a capacitor.

As a further example of the invention, with respect to FIG. 16, the conductor 1100*a* can be a signal conductor, and the conductor 1100*b* can be a ground conductor. The thick film layer 1114 extends over the top of at least a portion of the signal conductor 1100*a* to overlap with the signal conductor 1100*a*. The first thick film layer 1112 is an insulative layer, and the second thick film layer 1114 is a lossy or low conductivity material. In this configuration, the second thick film layer 1114 effectively extends the shielding effects of the ground conductor 1100*b* over to the signal conductor 1100*a*. This may be useful, for instance, if the signal conductor 1100*a* needs to be shielded to the right side of the circuit shown, and the ground conductor 1100*b* cannot be extended to that side. Accordingly, a conductive thick film or resistive lossy thick film can extend the shielding of the ground conductor 1100*b*. Thus, in a single lead frame stamping, the shielding of the ground conductor 1100*b* can be extended up and over at least a portion of the signal conductor 1100*a* by using the thick film layer 1114. The thick film layer 1114 is easier to connect to the ground conductor 1100*b* than a high conductivity metal conductor (which also has undesirable resonances). In another embodiment, the thick film layer 1114 can be a high dielectric.

Figure 17A:
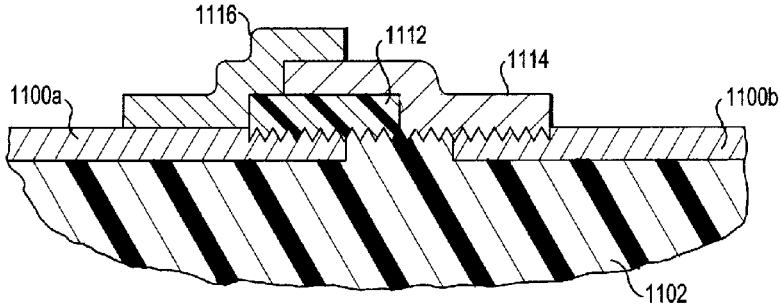
FIG. 17A is a cross-sectional view another embodiment of the invention showing three thick film layers.
Figure 17B:
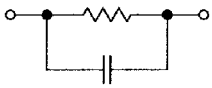
FIG. 17B is a circuit diagram of the embodiment of FIG. 17A.

Referring to FIG. 17A, a first and second layer 1112, 1114, are provided, as in FIG. 16. In addition, a third layer 1116 is formed over the first conductive element 1100*a*, the first layer 1112, and the second layer 1114. Here, the first layer 1112 is insulative, the second layer 1114 is a good conductor, and the third layer 1116 is resistive. That configuration forms a resistor by the third layer 1116 and a capacitor formed by the second layer 1114 and the first conductor 1100*a*, which are connected in parallel, as shown by FIG. 17B. On the other hand, if the second layer 1114 is resistive, then a resistor is formed in series with the capacitor shown in FIG. 17B.

Figure 18C:
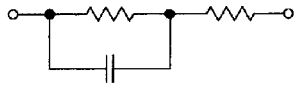
FIG. 18C is a circuit diagram of the embodiment of FIG. 18A.
Figure 18A:
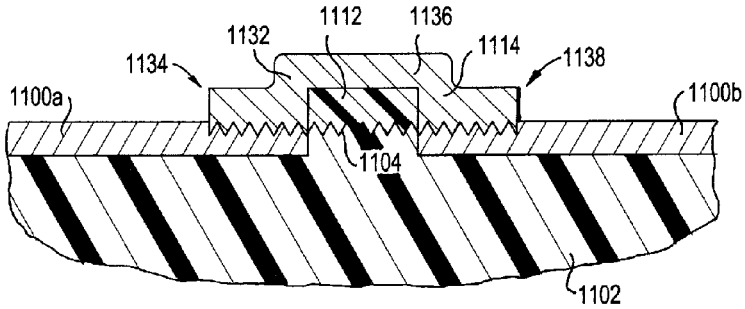
FIG. 18A is a cross-sectional view of another embodiment of the invention having two thick film layers.
Figure 18B:
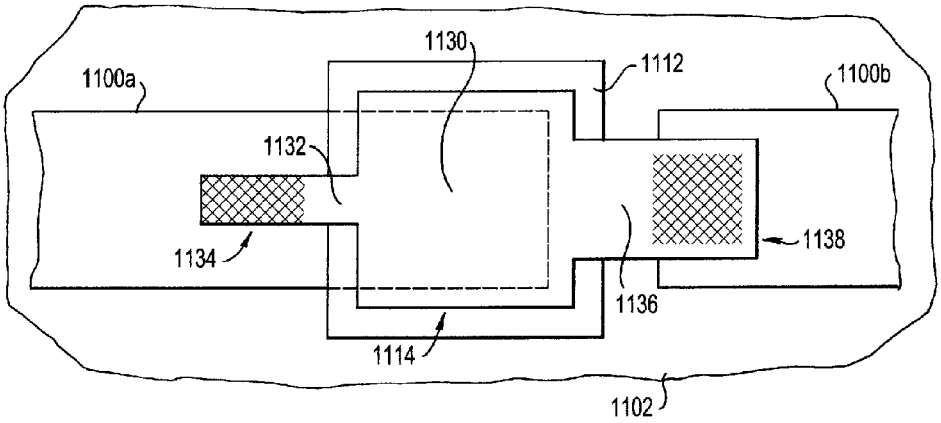
FIG. 18B is a top plan view of the embodiment of FIG. 18A.

In FIGS. 18A, B, C, another thick film configuration is shown. This has a similar structure as the embodiment of FIG. 16, except that the second layer 1114 extends over the first layer 1112 and contacts both of the first and second conductive elements 1100*a, b*. As best shown in FIG. 18B, the first layer 1112 has a generally square shape (though any shape can be provided). The first layer 1112 (which is an insulative, high dielectric constant thick film) extends over at least an end portion of the first conductor element 1100*a*. The second layer 1114 has a square-shaped (though any shape can be utilized) middle section 1130 and two arms 1132, 1136 which extend outward from opposite sides of the square middle section 1130. The first arm 1132 contacts the first conductor element 1100*a* at a first portion 1134, and the second arm 1136 contacts the second conductor element 1100*b* at a second portion 1138. As shown, the arms 1132, 1136 can have different widths and lengths from each other. However, the length and width of the arms 1132, 1136 can be the same. In addition, the length, width and conductivity of the second layer 1114 can be varied to achieve the desired level of conductivity or resistance, though generally the arms 1132, 1136 are not as wide as the middle section 1130.

The second layer 1114 is a lossy material which is not highly conductive. The configuration of FIGS. 18A, B form the circuit shown in FIG. 18C. The portion 1134 of the first arm 1132 which contacts the first conductor element 1100*a*, forms the resistor which is in parallel with the capacitor formed by the portions of the middle section 1130 and the first conductor 1100*a* which overlap one another. The second series resistor is formed by the portion 1138 of the second arm 1136 which contacts the second conductor element 1100*a*.

Figure 19:
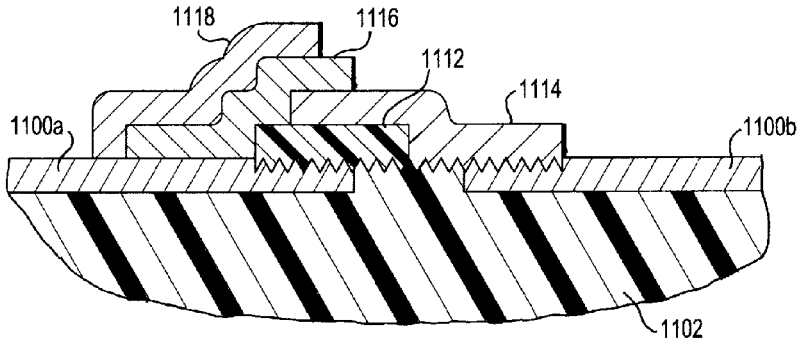
FIG. 19 is a cross-sectional view of another embodiment of the invention having four thick film layers.

FIG. 19 shows a configuration which doubles the capacitance of FIG. 18, to provide a multi-layer capacitor. A fourth layer 1118 is provided which essentially extends over the third layer 1116 and contacts the first conductor element 1100*a*. A first capacitor is formed by the portions of the first conductor element 1100*a* and the fourth layer 1118 which overlap each other. A second capacitor is formed by the portions of the second layer 1114 and the second conductor element 1100*b* which overlap each other. Thus, in FIG. 19, instead of having layer 1114 form a capacitor through insulator 1112 with the conductive element 1100*a*; another conductor 1118 extends on top of layer 1114 and insulated from it by layer 1116, and layer 1118 is connected to the conductor 1100*a* to form two parallel capacitors: a first one between conductor 1100*a* and conductor 1114 and a second one between conductor 1114 and layer 1118. Accordingly, additional alternating insulating and resistive layers can be provided to more than double the capacitance.

Figure 20A:
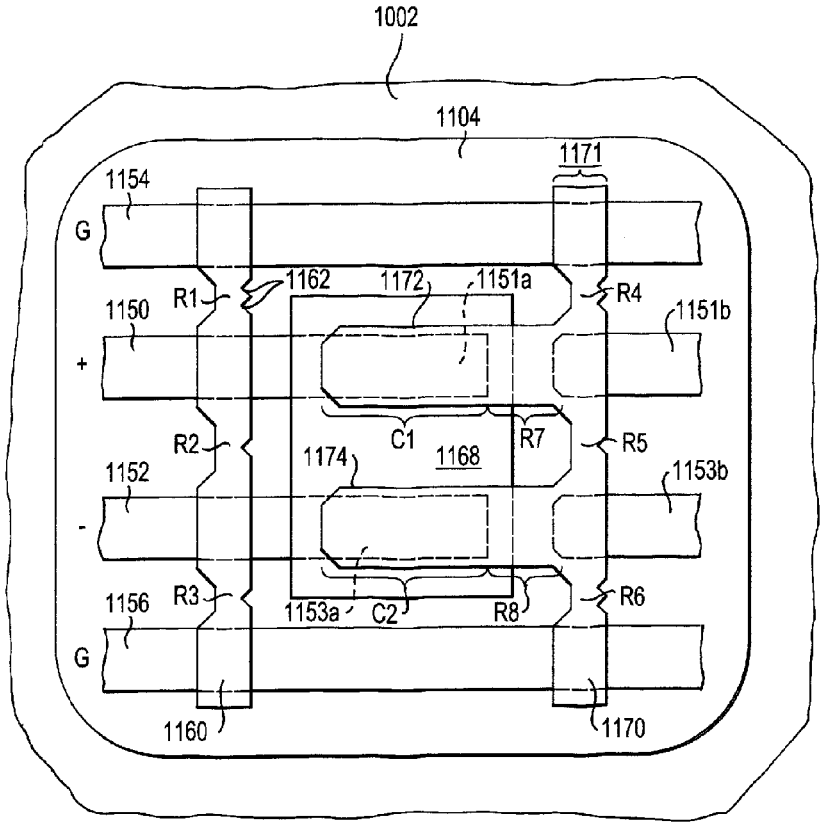
FIG. 20A is a top plan view of another embodiment of the invention for use with a differential signal pair and ground conductors.

Turning to FIGS. 20A, B, yet another configuration is shown. A differential signal pair is shown having a positive signal conductor 1150 and a negative signal conductor 1152. A ground conductor 1154, 1156 is provided on each side of the differential signal pair 1150, 1152, and the conductors 1150, 1152, 1154, 1156 are elongated and linear, and extend substantially parallel to one another. The signal conductors 1150, 1152 are cut or otherwise each formed as two signal conductor elements 1151*a, b* and 1153*a, b*, respectively.

A first thick film layer 1160 generally has the shape of an elongated rectangle which is disposed on, and substantially orthogonal (though any suitable angle can be used) to both of the signal pairs 1150, 1152 and the ground conductors 1154, 1156. The first layer 1160 has a resistance, which can be adjusted by providing notches 1162 on one or both sides of the first layer 1160. A second thick film layer 1168 is provided as an insulator which extends over both of the signal conductors 1150, 1152. A third thick film layer 1170 is provided with a main body 1171 which has the same general elongated rectangle shape as the first layer 1160. Two elongated arms or tongues 1172, 1174 extend out from the main body 1171 to form a general connected double-T shape (when viewed sideways in the embodiment of FIG. 20A). The main body 1171 connects to the two ground conductors 1154, 1156 and the second signal conductor elements 1151*b*, 1153*b*. The tongues 1172, 1174 extend directly over the second layer 1168 and are aligned over the first signal conductor elements 1151*a*, 1153*a*. It should be noted that the second layer 1168 is formed first, followed by the first and third layers 1160, 1170, which can be formed simultaneously.

Figure 20D:
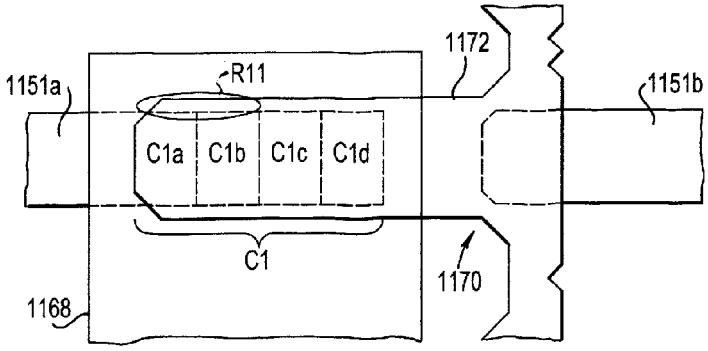
FIG. 20B is a circuit diagram of the embodiment of FIG. 20A.
FIG. 20C is a circuit diagram for an alternative configuration of FIG. 20A; and, FIG. 20D is an exploded configuration showing a distributed capacitor and resistor network.
Figure 20B:
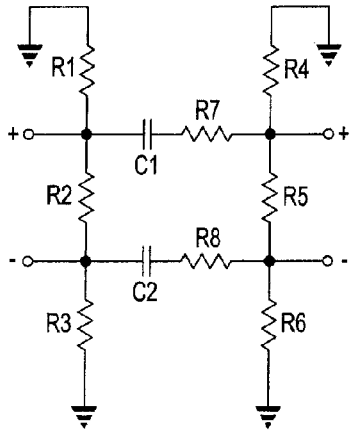

The configuration of FIG. 20A results in the circuit shown in FIG. 20B. The resistors $R_1$-$R_3$ are created by the first layer 1160, and the resistors $R_4$-$R_6$ are created by the main body 1171 of the third layer 1170. The resistive values are realized at the positions on the first layer 1160 located between the respective conductors 1150, 1152, 1154, 1156. As shown in FIG. 20A, the DC blocking capacitors $C_1$, $C_2$ or filtering elements, are formed by the overlapping portions of the first signal conductor elements 1151*a*, 1153*a* and the respective tongues 1172, 1174 of the third layer 1170. And, the resistors $R_7$, $R_8$ are formed by the respective tongues 1172, 1174 at the respective regions which overlie the gaps between the ends of the first signal conductor elements 1151*a*, 1153*b*.

The electrical characteristics of the conductor 1150 are determined by its width and thickness, the spacing to conductor 1152 and the spacing to ground 1154, 1156. To optimize the electrical characteristics of the circuit formed from the resistive and capacitive thick film elements, the undesired parasitics (such as the inductive component of the resistor 1172) are also controlled. To do so, the width of the tongue 1172 can be adjusted to provide a desired high frequency electric characteristics matching or parasitics with the conductors 1150, 1151*a, b*. And, the width of the tongue 1174 can be adjusted to provide a desired high frequency electric characteristics matching or parasitics with the conductors 1152, 1153*a, b*. In particular, the width of the tongues 1172, 1174 can be widened if the conductors 1151*a, b* and 1153*a, b* are widened, especially in the area where $R_7$, $R_8$ are formed. The characteristics can be flexibly adjusted by the thick films.

Figure 20C:
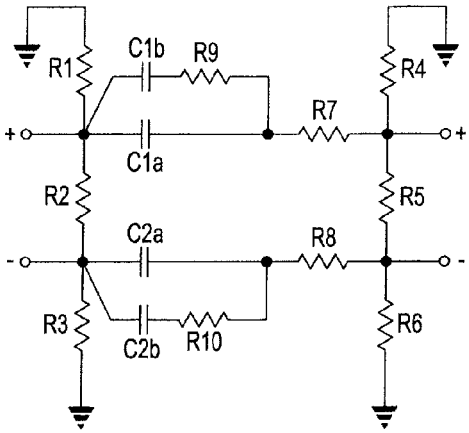

The embodiment of FIG. 20A can also be configured to provide the circuit diagram of FIG. 20C. Here, the capacitor $C_1$ of FIG. 20B is effectively a distributed capacitor and the resistor $R_7$ is a distributed resistor due to the length of the overlapping portions of the tongue 1172 in the horizontal direction (of FIG. 20A) and the conductor 1151*a*, and at higher frequencies. Thus, two capacitors $C_{1a}$, $C_{1b}$ effectively form capacitance $C_1$, and capacitors $C_{2a}$, $C_{2b}$ form capacitance $C_2$, in the embodiment of FIG. 20C. It should also be noted that if the conductor element 1151*a* is replaced by a lower resistive layer, that would also form a distributed resistor.

Referring to FIG. 20D, the tongue 1172 and the conductor element 1151*a* of FIG. 20A are exploded and elongated to have sufficient horizontal length and at a higher frequency to form a distributed capacitor/resistor network. Here, the configuration is shown having four capacitors for purposes of illustration: capacitor $C_{1a}$ in the left quadrant of the overlapping portion of conductor element 1151*a* and tongue 1172, capacitors $C_{1b}$ and $C_{1c}$ in the left and right middle quadrants, and capacitor $C_{1d}$ in the rightmost quadrant. In addition, a resistance is formed between each of those four distributed capacitors $C_{1a}$, $C_{1b}$, $C_{1c}$ and $C_{1d}$, at the portions of tongue 1172 which extend below the adjacent ones of those capacitors. For instance, the top layer (not underneath) forms resistor $R_{11}$, which is shown at the region above the parallel capacitors $C_{1a}$ and $C_{1b}$.

Those parallel capacitors $C_{1a}$ and $C_{1b}$ are both connected to conductor 1150, but on the top they are connected to conductor 1151 by an intermediate resistor $R_{11}$. Similar resistors are formed between capacitors $C_{1b}$ and $C_{1c}$, and between $C_{1c}$ and $C_{1d}$. Collectively, the distributed capacitors $C_{1a}$, $C_{1b}$, $C_{1c}$ and $C_{1d}$ form the one large capacitor $C_1$. As the frequency continues to increase, additional capacitors and resistors are formed in series along the length of that overlapping portion. The capacitor $C_2$ can also be controlled in the same manner to form distributed capacitors and resistors. The circuit diagram of FIG. 20C and the configurations of FIGS. 20A and 20D each provide a different frequency response.

Additionally, the conductor 1150 can stop further to the left (in the embodiment shown), and extend it with a resistive element 1151*a*, so there is a resistive strip on either side of the capacitor $C_1$. That would be configured by first setting the conductor 1150, extending it by a resistive layer 1151*a*, followed by a dielectric layer on top of it, and another resistive layer on top. That provides distributed resistors underneath and on top of distributed capacitors.

As illustrated by the embodiment of FIG. 20A, thick films can be applied to multiple conductors. Though the thick films 1160, 1168, 1170 are shown connected to two or more conductors, it should be apparent that any one or more of those films can be connected to fewer conductors. For instance, the second thick film 1168 can be replaced by two thick films, each of which are disposed only on one of the conductors 1151*a* or 1153*a*. Also, the first thick film 1160 need not connect all of the conductors 1150, 1152, 1154, 1156, but can instead only connect two or more of those conductors 1150, 1152, 1154, 1156. Thus, any suitable connections can be made as needed for a particular application of the invention.

In addition, a thick film layer can be formed between one of the signal conductors 1150, 1152, and a respective ground conductor 1154, 1156. For instance, a thick film layer can be formed between to connect with the ground conductor 1154 and overlap the signal conductor 1150. Or, the thick film layer 1168 can be extended to overlap the ground conductors 1154 and/or 1156. Still further, a thick film can be placed beneath one or more of the conductors 1150, 1152, 1154, 1156 where the conductor 1150, 1152, 1154, 1156 connects with the first thick film layer 1160, to form a capacitor at those crossing regions. A roughened surface can be created under those crossing regions to enhance the connection. In yet another embodiment of the invention, the second thick film layer 1168 (or a separate thick film layer) can be extended to one or more of those crossing regions, so that the first thick film layer 1160 is capacitively connected with the conductors 1150, 1152, 1154, 1156, instead of resistively $R_1$, $R_2$, $R_3$.

As further illustrated in FIG. 20A, the signal conductors 1150, 1152, 1154, 1156 can be disposed in an insulative housing 1002 as part of a connector wafer. The conductors

1150, 1152, 1154, 1156 are stamped from metal as part of a lead frame. The insulative housing 1002 is insert molded to the lead frame, and then the thick film layers are formed over the conductors 1150, 1152, 1154, 1156. An opening or aperture 1004 can be provided in the insulative housing 1002, in order for the thick film layers to be formed after the insulative housing 1002 is formed about the lead frame. The aperture 1004 can be provided on both sides of the lead frame, so that the thick film layers can be formed on one or both sides of the conductors 1150, 1152, 1154, 1156. Accordingly, the thick film layers are formed on the conductors of a connector without disrupting the mechanical structure of the conductors, but electrically enhancing the properties of those conductors.

As shown, the roughened surface 1104 preferably extends along the entire surface of the insulative housing 1102 which is in the space 1105 between the conductors 1100*a, b*. The roughened surface 1104 also extends into at least a portion of the upper surface of both of the signal conductor elements 1110*a, b*. However, the roughened surface 1104 need not extend along both conductor elements 1100*a, b* or the entire surface of the insulative housing 1102 in the gap 1105. In addition, portions of the thick film layers are shown in contact with the insulative housing 1102 at the gap 1105, such as the first and second layers 1112, 1114 of FIG. 18A. However, one skilled in the art will appreciate that the insulative housing 1102 at the gap 1105 provides structural support to enable the thick films to be formed, and does not affect the electrical properties. Thus, the layers need not extend into the gap 1105, so long as they are in contact with the conductor elements 1100*a, b*.

In accordance with the preferred embodiments, the thick film layers 1106, 1112, 1114, 1116, 1118 have a thickness of approximately 0.5-5 mils, a width of about 5-20 mils, and a length of about 20-100 mils. The gap 1104 would be about 10-50 mils. The layers can have a surface resistivity of about 10-1,000 ohms per square. All of the thick films that have been discussed, can be layers which are formed in any suitable manner, such as by an organic resin-based printable inks and adhesive combinations that could be cured in the range of 150-200 degrees Celsius, or alternatively by a more conventional thick film process of screening a paste and curing it. Preferably, however, the thick film is a polymer thick film material or ink, which can be cured at approximately 100 degrees Celsius, since those temperatures are compatible with connectors constructed of injection molded and insert molded plastic components. Suitable polymer thick films are discussed, for instance, in Polymer Thick Film by Ken Gilleo, ©1996 and offered by Creative Materials, which are incorporated herein by reference. Although thick films are described in the preferred embodiments, other methods of creating the conductive, resistive, dielectric, or magnetic layers besides thick film could be used to implement the invention, such as vapor deposition or sputtering of thin film material. In addition, an insulative protective coating can be applied over the top of the thick film layers shown, and in particular to keep out moisture and debris.

Thus, the invention provides a device and process for incorporating SMT resistors, capacitors, or other components into a connector by soldering or otherwise attaching them to internal portions of the connector contacts. This invention uses thick film methods including screening and curing to create such components as an integral part of a connector. The conductive signal and/or ground contacts are constructed by stamping or other means to have gaps or spaces either between two successive sections of the same conductor or between sections of two adjacent conductors, or both.

The insulative body of the connector or connector wafer is so constructed as to provide a relatively flat or clear insulative area of potential connection between said conductive sections. This insulative area is constructed so as to be accessible to and adapted for screen printing or other application of one or more patterns and/or layers of resistive, conductive, dielectric, or magnetically permeable materials in the form of thick film or thin films or individual pieces. Of course laser or other trimming processes may be used to adjust the resulting component values or network characteristics. The invention has application in interconnection devices such as connectors, cables, IC packages, sockets, and Printed Wiring Boards.

As an alternative to the surface mount attachment of discretely fabricated resistive, capacitive, inductive, filter, or other components, typically on small ceramic substrates, this invention offers advantages of lower cost, reduced handling and manufacturing complexity, and better high frequency performance due to the elimination of the parasitic capacitance and/or inductance of surface mount pads, solder or adhesive joints, and the solder terminals on the discrete components. By eliminating the extra level of connection between connector conductors and the terminal structures on the discrete component alternatives, this invention provides improved reliability and also saves space.

Having described the preferred embodiments of the invention, it will now become apparent to one of ordinary skill in the art that other embodiments incorporating their concepts may be used. Accordingly, these embodiments should not be limited to the disclosed embodiments but rather should be limited only by the spirit and scope of the appended claims. Although certain presently preferred embodiments of the disclosed invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law. All publications and references cited herein are expressly incorporated herein by reference in their entirety.

The invention claimed is:

1. An electrical connector comprising:

an insulative housing having a surface;

a signal conductor disposed on the surface of said insulative housing, said signal conductor having a first contact end, a second contact end, and an intermediate portion therebetween, said intermediate portion having a first signal conductor segment and a second signal conductor segment spatially separated from the first signal conductor segment; and, a thick film layer disposed on at least a portion of said first signal conductor segment, at least a portion of said insulative housing, and at least a portion of said second signal conductor segment.

2. The electrical connector of claim 1, wherein said thick film layer has a resistance.

3. The electrical connector of claim 1, wherein the surface at said portion of said insulative housing is roughened or grooved to facilitate a connection between said thick film layer and said insulative housing.

4. The electrical connector of claim 1, wherein a surface of said portions of the first and second signal conductor segments are roughened or grooved to facilitate a connection between said thick film layer and said portion of the first and second signal conductor segments.

5. A method for adding a circuit element to an electrical connector, comprising the steps of:

providing at least one opening in an insulative housing of an electrical connector to expose a first signal conductor;

forming a first gap in the first signal conductor, thereby forming a first segment with a first contact end and a second segment with a second contact end, wherein the first gap is accessible in the at least one opening; and covering at least a portion of the at least one opening with a first thick film, wherein the thick film covers at least a portion of the first and second segments and the first gap.

6. An electrical connector comprising:

an insulative housing having a surface;

a signal conductor having a first contact end, a second contact end, and an intermediate portion therebetween, said intermediate portion having a first signal conductor segment and a second signal conductor segment spatially separated from the first signal conductor segment;

a first thick film layer disposed on at least a portion of said first signal conductor segment; and, a second thick film layer disposed on at least a portion of said first thick film layer and at least a portion of said second signal conductor segment.

7. The electrical connector of claim 6, wherein said first thick film layer is not disposed on said second signal conductor segment and said second thick film layer is not disposed on said first signal conductor segment.

8. The electrical connector of claim 7, wherein said second thick film layer is disposed over said first signal conductor segment to form a capacitor therewith.

9. The electrical connector of claim 8, wherein said second thick film layer is resistive, and further forms a resistor with the capacitor, in series with said first and second signal conductor segments.

10. The electrical connector of claim 7, further comprising a third thick film layer disposed on said first signal conductor segment and second thick film layer.

11. The electrical connector of claim 10, further comprising a fourth thick film layer disposed on said first signal conductor segment and said third thick film layer.

12. The electrical connector of claim 6, wherein said first thick film layer is insulative and said second thick film is a good conductor.

13. The electrical connector of claim 6, wherein said first thick film layer is insulative and said second thick film is resistive.

14. The electrical connector of claim 6, wherein said second thick film layer is further disposed on said first signal conductor segment.

15. The electrical connector of claim 14, wherein said first thick film layer is insulative and said second thick film layer is a lossy material.

16. The electrical connector of claim 15, wherein said first thick film layer has a high dielectric constant.

17. The electrical connector of claim 14, wherein said second thick film layer has two ends and a middle therebetween, wherein the two ends have a resistance and the middle is disposed over said first signal conductor segment and forms a capacitance therewith.

18. The method according to claim 5, further comprising the step of etching at least a portion of the first thick film to achieve a desired level of electrical resistance.

19. An electrical connector comprising:

an insulative housing having a surface;

a differential signal pair comprising a first signal conductor having a first contact end, a second contact end, and a first intermediate portion therebetween, said first intermediate portion having a first signal conductor segment and a second signal conductor segment spatially separated from the first signal conductor segment, and a second signal conductor having a third contact end, a fourth contact end, and a second intermediate portion therebetween, said second intermediate portion having a third signal conductor segment and a fourth signal conductor segment spatially separated from the third signal conductor segment; and, a first thick film layer disposed on at least a portion of said first signal conductor segment and a portion of said third signal conductor segment.

20. The electrical connector of claim 19, further comprising a second thick film layer disposed on said first thick film layer and said second signal conductor segment.

21. The electrical connector of claim 20, wherein said second thick film layer is further disposed on said further signal conductor segment.

22. The electrical connector of claim 21, wherein said second thick film layer is connected to at least one ground conductor.

23. The electrical connector of claim 22, further comprising a third thick film layer connected to said first and third signal conductor segments and said at least one ground conductor.

24. The method according to claim 5, wherein the step of providing at least one opening in an insulative housing of an electrical connector comprises the steps of:

receiving a plurality of existing wafers; and modifying the plurality of existing wafers to each have the at least one opening.

25. A method of forming an electrical connector comprising:

providing an insulative housing having a surface;

providing a signal conductor disposed on the surface of said insulative housing, said signal conductor having a first contact end, a second contact end, and an intermediate portion therebetween, said intermediate portion having a first signal conductor segment and a second signal conductor segment spatially separated from the first signal conductor segment; and, disposing a thick film layer on at least a portion of said first signal conductor segment, at least a portion of said insulative housing, and at least a portion of said second signal conductor segment.

26. The method of claim 25, further comprising the step of insert molding the signal conductor into an insulative housing.

27. The method according to claim 5, wherein the insulative housing is formed using an overmolding process.

28. The method according to claim 5, further comprising adding a second thick film on top of the first thick film.

29. The method according to claim 5, wherein the first thick film has a conductivity ranging from about 1:100 and about 1:1,000,000 of that of standard pure copper.

30. The method according to claim 5, wherein the first thick film is a lossy dielectric, a lossy polymer resin, or a lossy magnetic material.

31. The method according to claim 30, wherein the lossy magnetic material is one of a ferrite and a ferrite-particle-filled polymer resin matrix.

* * * * *